US010421586B2

(12) United States Patent
Koehl et al.

(10) Patent No.: US 10,421,586 B2
(45) Date of Patent: Sep. 24, 2019

(54) INSULATED DRINK CONTAINER SEALING AND LID RETENTION DEVICE

(71) Applicant: REACTIVE DESIGNS LLC, Dallas, TX (US)

(72) Inventors: George Koehl, Dallas, TX (US); Jeffery Gallagher, Princeton, TX (US)

(73) Assignee: Reactive Designs LLC, Dallas, TX (US)

( * ) Notice: Subject to any disclaimer, the term of this patent is extended or adjusted under 35 U.S.C. 154(b) by 11 days.

(21) Appl. No.: 15/497,041

(22) Filed: Apr. 25, 2017

(65) Prior Publication Data

US 2017/0305614 A1 Oct. 26, 2017

Related U.S. Application Data

(60) Provisional application No. 62/326,843, filed on Apr. 25, 2016.

(51) Int. Cl.

| | |
|---|---|
| ***B65D 43/02*** | (2006.01) |
| ***B65D 85/72*** | (2006.01) |
| ***A47G 23/02*** | (2006.01) |
| ***B65D 55/16*** | (2006.01) |

(52) U.S. Cl.

CPC ..... *B65D 43/0216* (2013.01); *A47G 23/0216* (2013.01); *B65D 43/022* (2013.01); *B65D 55/16* (2013.01); *B65D 85/72* (2013.01); *A47G 23/0233* (2013.01); *B65D 2251/1025* (2013.01); *B65D 2251/1041* (2013.01)

(58) Field of Classification Search

CPC ..... B65D 43/0212; B65D 43/0216; B65D 43/022; A47G 23/0216

USPC ..... 220/715, 233, DIG. 19

See application file for complete search history.

(56) References Cited

U.S. PATENT DOCUMENTS

| | | | | |
|---|---|---|---|---|
| 3,650,432 | A * | 3/1972 | Easton | B65D 17/506 220/791 |
| 3,807,595 | A * | 4/1974 | Zundel | B65D 17/16 220/260 |
| 5,863,655 | A * | 1/1999 | Mock | B29C 45/0081 215/235 |
| 5,944,228 | A | 8/1999 | Gray | |

(Continued)

FOREIGN PATENT DOCUMENTS

| | | |
|---|---|---|
| EP | 2743201 | 6/2014 |
| JP | 57-55753 U | 4/1982 |
| WO | WO2005/102121 | 11/2005 |

OTHER PUBLICATIONS

Notification of Transmittal of the International Search Report and the Written Opinion of the International Searching Authority issued in PCT/US2017/029450 dated Aug. 2, 2017, 15 pages.

*Primary Examiner* — Jeffrey R Allen

(74) *Attorney, Agent, or Firm* — Fish & Richardson P.C.

(57) ABSTRACT

An accessory includes a container band having an inner surface configured to conform to and engage an outer surface of a container, and an arm member connected to and extending from the container band. The arm member selectively engages a lid of the container. The arm member includes an arm body, a spout plug extending from the arm body, where the spout plug is configured to selectively seal a spout opening in the lid of the container, and a vent cover extending from the arm body, where the vent cover is configured to selectively seal a vent opening of the lid of the container.

15 Claims, 7 Drawing Sheets

(56) References Cited

U.S. PATENT DOCUMENTS

| | | | | |
|---|---|---|---|---|
| 9,480,833 | B2 * | 11/2016 | Hoang | A61M 39/16 |
| 2006/0096987 | A1 * | 5/2006 | Wry | A47G 23/0266 220/375 |

* cited by examiner

700

INSULATED DRINK CONTAINER SEALING AND LID RETENTION DEVICE

CROSS-REFERENCE TO RELATED APPLICATIONS

This application claims priority to U.S. Provisional Application, Ser. No. 62/326,843, entitled "Container Device," filed on Apr. 25, 2016, the entire contents of which is hereby incorporated by reference.

TECHNICAL FIELD

This disclosure relates to an accessory for insulated drink containers.

BACKGROUND

A user of an insulated drink container ("container") (for example, insulated tumblers) in an automobile, while at a sporting event, concert, work, or school, often faces situations where hot or cold drinks placed into the container become lukewarm after a period of time or spill if the container is accidently knocked over. Additionally, the user often finds it frustrating to search for a place to situate the insulated drink container's lid while refilling or cleaning the insulated drink container so that the lid does not become unsanitary or lost.

SUMMARY

This disclosure describes an accessory for insulated drink containers.

In a first aspect, an accessory includes a container band including an inner surface configured to conform to and engage an outer surface of a container, and an arm member connected to and extending from the container band, the arm member configured to selectively engage a lid of the container. The arm member includes an arm body, a spout plug extending from the arm body, the spout plug configured to selectively seal a spout opening in the lid of the container, and a vent cover extending from the arm body, the vent cover configured to selectively seal a vent opening of the lid of the container.

In a second aspect according to the first aspect, the arm member can include an attachment band coupled to the container band, the attachment band connecting the arm body to the container band, the attachment band configured to permit movement of the arm member between a closed first position and an open second position.

In a third aspect according to the second aspect, the attachment band can be tensioned to bias the arm member toward at least one of the closed first position or the open second position.

In a fourth aspect according to any one of the second aspect or the third aspect, the attachment band can be integrally attached to the container band.

In a fifth aspect according to any one of the second aspect to the fourth aspect, the arm body can connect to the attachment band at a first end of the arm body, and the spout plug can be disposed at a second end of the arm body opposite the first end.

In a sixth aspect according to any one of the first aspect to the fifth aspect, the spout plug can include a protrusion extending from a bottom surface of the arm body, the spout plug configured to engage and selectively attach to the spout opening of the lid of the container.

In a seventh aspect according to the sixth aspect, the protrusion can include a lip flange extending laterally from the protrusion, the lip flange configured to engage an underside surface of the lid adjacent the spout opening.

In an eighth aspect according to any one of the first aspect to the seventh aspect, the vent cover can include a protrusion extending from a bottom surface of the arm body, the vent cover configured to cover the vent opening of the lid of the container.

In a ninth aspect according to the eighth aspect, the protrusion of the vent cover can include an indentation forming a lip edge at a periphery of the indentation, the lip edge configured to engage a top surface of the lid and surround the vent opening.

In a tenth aspect according to any one of the first aspect to the ninth aspect, the arm member can include a reinforcing rib extending along a longitudinal length of the arm body.

In an eleventh aspect according to any one of the first aspect to the tenth aspect, the container band can include a concavity configured to be positioned adjacent the spout opening of the lid of the container.

In a twelfth aspect according to the eleventh aspect, the container band can include a protrusion extending from an outer surface of the container band adjacent the concavity.

In a thirteenth aspect according to any one of the first aspect to the twelfth aspect, the container band and the arm member can be formed from a single type of flexible polymer material.

In a fourteenth aspect according to any one of the first aspect to the thirteenth aspect, the container band and the arm member can be molded from a flexible polymer material.

In a fifteenth aspect, a method for sealing a container lid includes engaging, with a container band of an accessory, an outer surface of a container, engaging, with an arm member connected to and extending from the container band, a lid of the container, and sealing, with the arm member, a spout opening of the lid and a vent opening of the lid.

In a sixteenth aspect according to the fifteenth aspect, the method can include disengaging the arm member from the lid of the container.

In a seventeenth aspect according to any one of the fifteenth aspect or the sixteenth aspect, the method can include rotating the arm member with respect to the container band.

In an eighteenth aspect according to the seventeenth aspect, wherein rotating the arm member with respect to the container band can include biasing, with an attachment band of the arm member coupled to the container band, the arm member toward at least one of a closed first position or an open second position of the arm member, the attachment band connecting the arm member to the container band.

In a nineteenth aspect according to any one of the fifteenth aspect to the seventeenth aspect, sealing, with the arm member, a spout opening of the lid and a vent opening of the lid can include sealing the spout opening with a spout plug of the arm member, the spout plug configured to selectively seal the spout opening, and sealing the vent opening with a vent cover of the arm member, the vent cover configured to selectively seal the vent opening.

In a twentieth aspect, an accessory includes a container band including an inner surface configured to conform to and engage an outer surface of a container, a spout plug connected to the container band, the spout plug configured to selectively seal a spout opening in a lid of the container, and a vent cover connected to the container band, the vent cover configured to selectively seal a vent opening of the lid of the container.

In a twenty-first aspect according to the twentieth aspect, the vent opening can include an indentation forming a lip edge at a periphery of the indentation, the lip edge configured to engage a top surface of the lid and surround the vent opening.

The subject matter described in this specification can be implemented in particular implementations, so as to realize one or more of the following advantages. First, the described accessory provides an air-tight and liquid-tight seal for an insulated drink container ("container") for both the pour spout and vent hole. The provided seal helps to keep the liquids in the container at a desired temperature for a longer period of time. Second, the seal provided by the accessory helps to avoid spills if the container is accidently knocked over. Third, the accessory can secure the lid to the container when the lid is removed for refilling or cleaning the container. In this way, the lid is retained with the container, kept sanitary, and a risk of lid loss is reduced. Fourth, the accessory provides a non-slip gripping surface for a user. Fifth, the configuration of the accessory prevents the sealing mechanism from flopping into a user's face when using the container with the attached accessory. Sixth, the accessory can provide advertising or messaging space on exterior surfaces of the accessory. Other advantages will be apparent to those of ordinary skill in the art.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
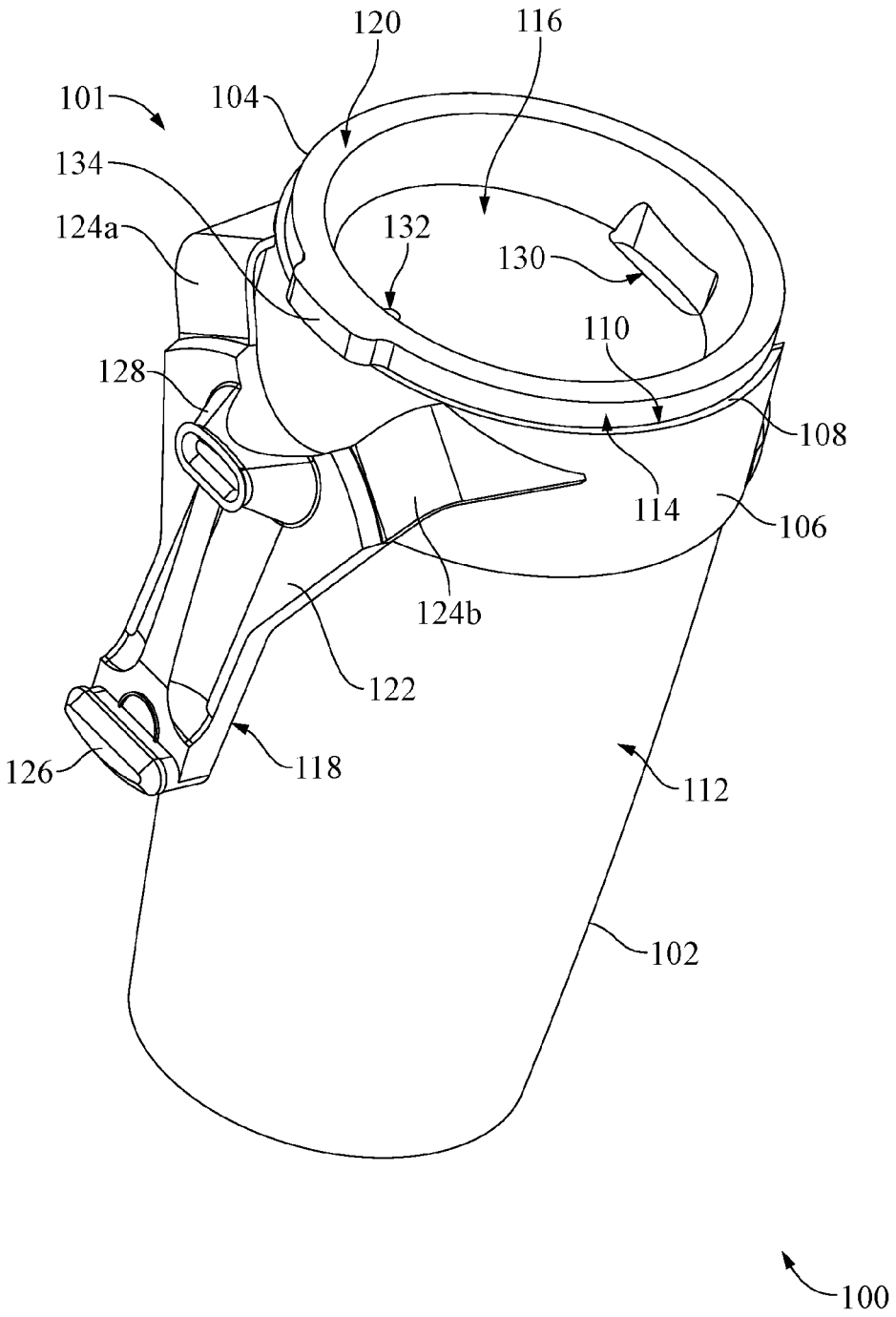
FIG. 1 is a rear perspective view of an accessory attached to an insulated drink container ("container") with the accessory in an open position, according to an implementation.

The following detailed description describes an accessory for an insulated drink container ("container"), and is presented to enable any person skilled in the art to make and use the disclosed subject matter in the context of one or more particular implementations. Various modifications, alterations, and permutations of the disclosed implementations can be made and will be readily apparent to those or ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

At a high-level, an accessory for a container is configured to selectively seal one or more openings of a lid of the container, for example, a lid to an insulted tumbler-type cup, bottle, thermos, or another handheld drink container. The configuration of the accessory also permits retaining the lid of the container to allow sanitary and efficient refills of the container. Although not illustrated, the described accessory can also be used, among other things, to provide advertising space (for example, printed or molded on any exterior surface of the accessory) and an enhanced grip on the container (for example, configured with ridges, indentations, patterns, and the like, to provide a non-slip gripping surface).

While the disclosure focuses, for purposes of explanation, on use of the accessory with an insulated, hand-held drink container (for example, a YETI- or RTIC-type insulated container), in other implementations, it is not necessary for the container to be insulated, handheld, or for holding potable substances. For example, the containers could be for storage of industrial or other non-potable liquids. The containers can also be configured to be of any size. Other container configurations and sizes, inasmuch as they are consistent with the concepts presented in this disclosure, are also considered to be within the scope of this disclosure. Those of ordinary skill in the art will understand necessary changes to the accessory for use with alternatively-configured containers.

The accessory includes a container band that at least partially encircles a body of the container near an open or semi-open top of the container to secure the accessory to the container during use of the container by a user (for example, gripping the container and container band with a hand). A folding arm member configured to extend from the container band seals one or more openings at the top of the container when engaged with the top of the container, for example, an open top of the cup, or spout opening, vent opening, or one or more other openings of a lid of the container.

In typical implementations, the accessory is configured of a single flexible material, such as an elastomeric polymer (for example, rubber or silicone). In other implementations, the accessory can be configured of more than one material, such as the described flexible material and a semi-flexible or rigid material. For example, the accessory can be configured of both silicone and plastic. Typically, the accessory is molded from a flexible material as a single device. In other implementations, the accessory can be molded in two or more portions that are integrated by overmolding or attached together (for example, using an adhesive, chemical-type curing, heat, fasteners, or other attachment method).

To attach the accessory to the container, the container band can be engaged with and stretched around a portion of the container (for example, an upper portion of the container). Properties of the flexible material provide a friction- and compression-type grip to the outer surface of the container to secure the accessory in place.

To remove the accessory from the container, the container band can be stretched to release the friction- and compression-type grip of the container band from the container. A user can then remove the accessory from the container. In some implementations (not illustrated), the container band can be configured to provide strategically placed protrusions (for example, a tether point, such as a loop of material to attach the accessory to another item) or other graspable surfaces (for example, a small, non-obtrusive, finger-graspable nub or handle configured of the flexible, semi-flexible, or rigid material), for example, to allow the user to stretch the container band as described for attachment or removal of the accessory from the container.

FIG. 1 is a rear perspective view 100 of an accessory 101 attached to a container 102 with the accessory 101 in an open position, according to an implementation. The container 102 has a lid 104 removably-attached to an upper opening (for example, used to fill/re-fill the container) of the container 102.

As illustrated, the accessory 101 includes a container band 106 that encircles and engages with a portion of the container 102. In FIG. 1, the container band 106 encircles an upper portion of the container 102 and an upper edge surface 108 of the container band 106 substantially lines up with the upper edge surface (not illustrated) of the container 102. In some implementations, the container band 106 can also be configured to seal the lid 104 with the container 102 (for example, along the seam of the lid 104 when the lid 104 engages with the container 102).

While the container band 106 of the accessory 100 is shown in FIG. 1 as having a substantially cylindrical shape, the container band 106 can also be configured to conform to a variety of other configurable shapes (for example, oval, triangular, square, rectangular, or other shape) with respect to at least the upper portion of container 102.

In some examples, an inner surface 110 of the container band 106 conforms to and engages an outer surface 112 of the container 102. In some instances, the container band engages, at least in part, an outer surface 114 of the lid 104.

In some instances, the container band 106 can be configured to include an upper flange, elastic band, or other structure (not illustrated) that can extend radially inward from a top edge of the container band 106, for example, over at least an upper surface 120 or a top surface 116 of the lid 104 to permit retention of the lid 104 to the container 102. For example, an inwardly extending flexible flange can be molded into either side of the container band 106 on an axis perpendicular to an axis of rotation of an arm member 118. One or more of the inwardly-extending flexible flanges can extend over the upper surface 120 of the rim of the lid 104 to prevent the lid 104 from being inadvertently removed from the container 102. However, configured flexibility of the flanges can permit a user to purposely remove and re-install the lid 104 onto the container 102. In another example, the container band 106 can be configured with an elastic band that can stretch over and across a secured lid 104 to prevent the lid 104 from being inadvertently removed from the container 102. Pulling the elastic band up and away from the lid 104 would permit a user to purposely remove and re-install the lid 104 onto the container 102.

An arm body 122 of the arm member 118 is connected to and extends from the container band 106. As illustrated, the arm body 122 is connected integrally, directly, or indirectly to the container band 106 by an attachment band. In some implementations, the attachment band can be a single attachment band. The illustrated accessory 101 of FIGS. 1-2 includes two attachment bands 124*a*/124*b* that converge at the arm body 122 at a first end of the attachment band and splits into the two attachment bands 124*a*/124*b*. The attachment bands 124*a*/124*b* connect the arm body 122 to the container band 106, and are flexible to allow movement of the arm member 118 (particularly the arm body 122), between the open position illustrated in FIG. 1 and a closed position illustrated in FIG. 2. The attachment bands 124*a*/124*b* permit the arm member 118 to move (for example, rotate) to selectively engage and seal openings in the lid 104.

In the illustrated implementation, the divergence of the attachment bands 124*a*/124*b* and method of attachment (for example with a slight twist or bulge in the flexible material) to the container band 106 can generate a positive or negative spring bias (for example, to bias the arm member 118 into a closed or open position, respectively) when the arm member 118 is rotated along its movement axis. This generated bias is especially useful when the arm member 118 is in the open position to keep the arm member 118 against the side of the container 102 and to prevent the arm member 118 from closing against a user's face when the user tilts the container 102 to drink from an opening in the lid 104. Also, the attachment bands 124*a*/124*b* allow rotation between the open and closed positions of the arm member 118, and can limit movement or rotation in other directions, such as in a lateral direction or a shear movement. In some instances, the two attachment bands 124*a* and 124*b* bring a center of rotation of the arm member 118 closer to the container, for example, compared to a single, central attachment band. In some implementations, the described spring bias can be configured to bias the arm member 118 into an open, closed, or other desired position.

The divergence of the attachment band into the two attachment bands 124*a* and 124*b* creates an opening between the two attachment bands 124*a* and 124*b*, for example, allowing space, or clearance, for a rear tab 134 of the lid 104 to extend generally beyond a circumferential periphery of the lid 104 without interference from the accessory 101. The opening allows a user to access and remove the lid 104 from the container 102 using the rear tab 134 without the container band 106 interfering with the location of the rear tab 134.

The arm body 122 includes a spout plug 126 and a vent cover 128 extending from the arm body 122. The spout plug 126 can be used to selectively seal an appropriately-shaped and positioned spout opening 130 in the lid 104, and the vent cover 128 can be used to selectively seal an appropriately-shaped and positioned vent opening 132 in the lid 104. To selectively seal the spout opening 130 and the vent opening 132, the arm member 118 can move (for example, rotate) from an open position, as depicted in FIG. 1, to a closed position (refer to FIGS. 2 and 3). For example, when the arm member 118 is rotated into the closed position, spout plug 126 and vent cover 128 are positioned to engage with and seal, at least partially, spout opening 130 and vent opening 132.

Figure 2:
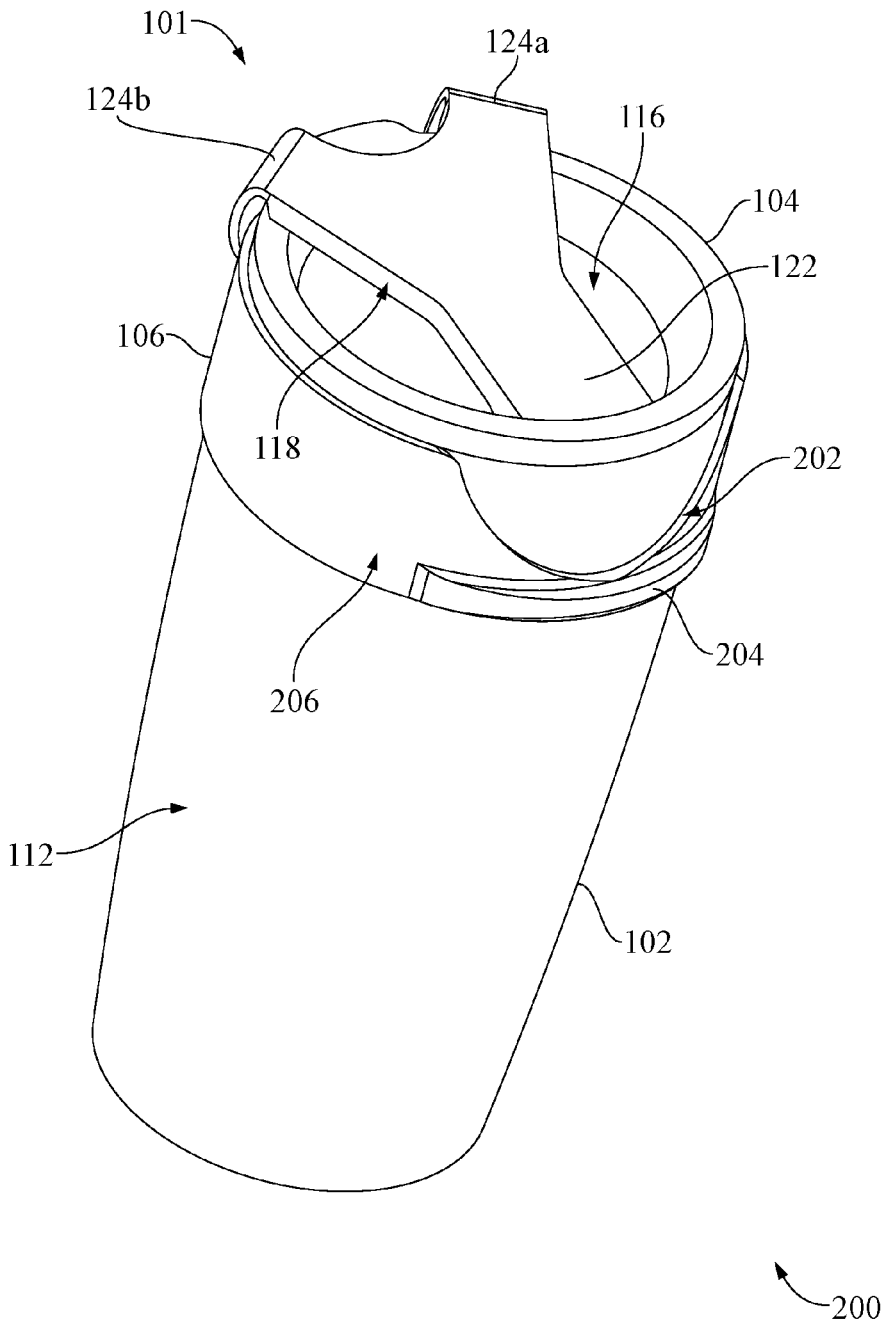
FIG. 2 is a front perspective view of the accessory of FIG. 1 attached to the container with the accessory in a closed position, according to an implementation.

FIG. 2 is a front perspective view 200 of the accessory 101 of FIG. 1 attached to the container 102 with the accessory 101 in a closed position, according to an implementation. As illustrated, the arm member 118 has been rotated into the closed position and spout plug 126 and vent cover 128 are positioned to engage with and seal, at least partially, spout opening 130 and vent opening 132.

In some implementations, the container band 106 includes a concavity 202 positioned adjacent to (for example, aligned with) the spout opening 130. The concavity 202 permits a user's lower lip to contact the lid 104 or container 102 without contacting the container band 106 when drinking from the container 102 through the spout opening 130. In the illustrated implementation, the container band 106 also includes a protrusion 204 extending from an outer surface 206 of the container band 106. The protrusion 204 can be positioned adjacent the concavity 202 to act as a finger rest for a user's finger when holding the container 102.

Figure 3:
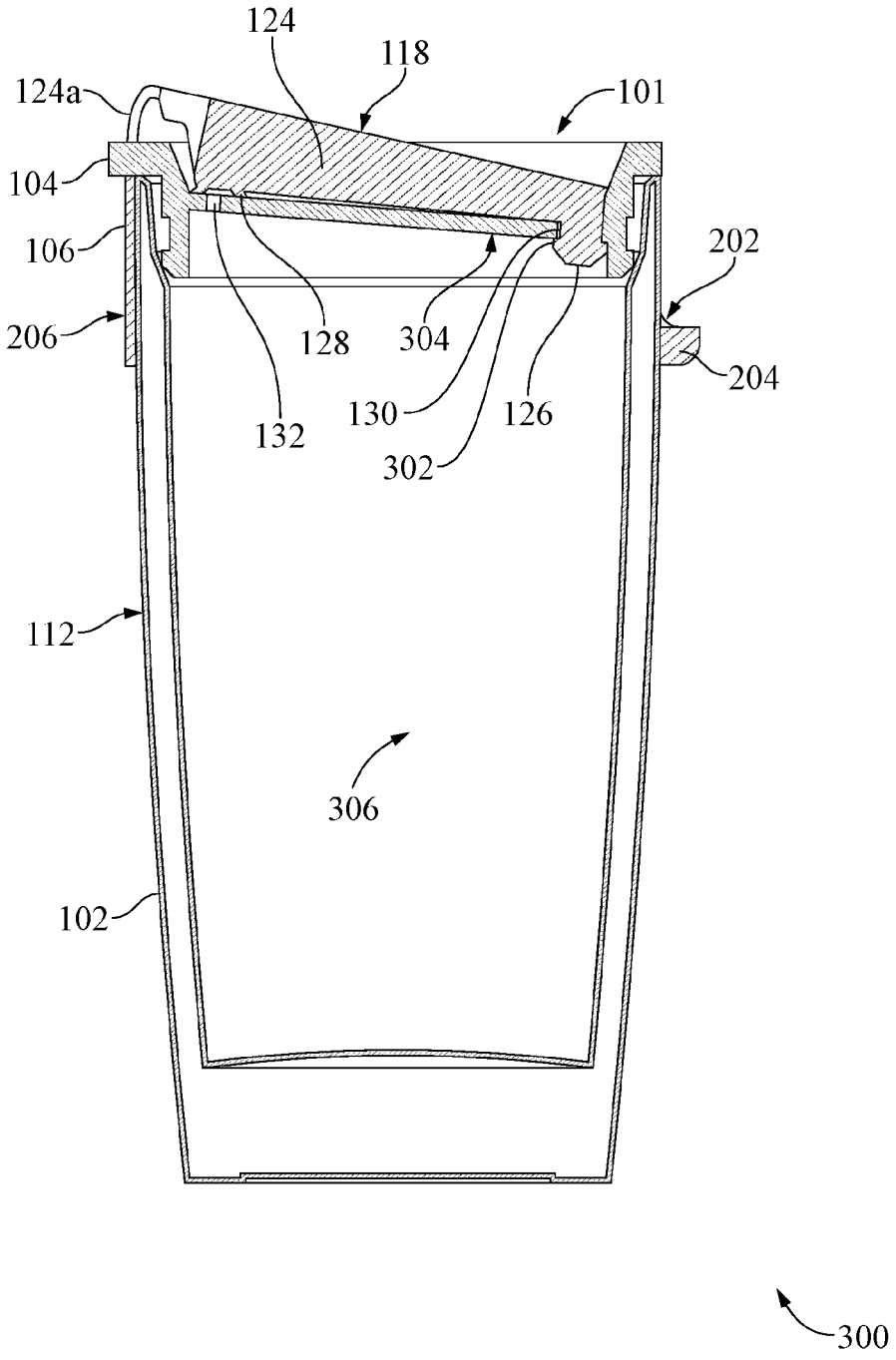
FIG. 3 is a cross-sectional side view of the accessory of FIGS. 1-2 attached to the container with the accessory in a closed position, according to an implementation.

FIG. 3 is a cross-sectional side view 300 of the accessory 101 of FIGS. 1-2 attached to the container 102 with the accessory 101 in a closed position, according to an implementation. As illustrated, spout plug 126 and vent cover 128 are positioned to engage with and seal, at least partially, spout opening 130 and vent opening 132, respectively. In some implementations, the spout plug 126 can be configured in varying shapes to seal differently-shaped spout opening 130. For example, the spout plug 126 can be a protrusion extending from the arm body 122 and can be configured to be flared, flanged, or ridged. As illustrated, spout plug 126 is configured with a lip flange 302 extending laterally from the spout plug 126 and configured to engage an underside surface 304 of the lid 102 adjacent to the spout opening 130. In some implementations the spout plug 126 can seal and be retained by a compression fit in the spout opening 130 without the lip flange 302.

The vent cover 128 (for example, a protrusion shaped like a suction cup) can be configured to cover and seal the vent opening 132. In some instances, the vent cover 128 can be configured in varying shapes and thicknesses to permit the vent opening 132 to vent periodically (for example, with pressure generated by hot or carbonated liquids held in the interior 306 of container 102).

Figure 4:
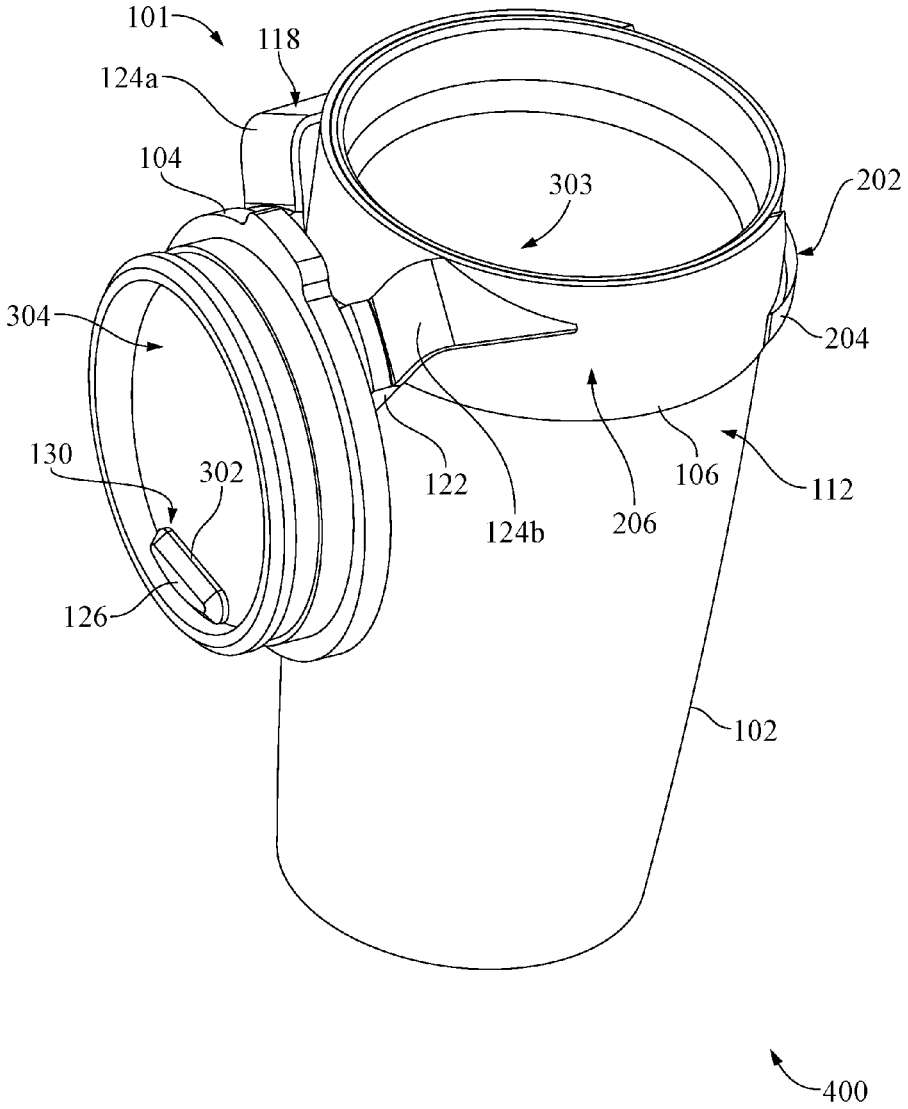
FIG. 4 is a rear perspective view of the accessory of FIGS. 1-3 attached to the container with the accessory in an open, engaged position with a lid of the container, according to an implementation.

FIG. 4 is a rear perspective view 400 of the accessory 101 of FIGS. 1-3 attached to the container 102 with the accessory 101 in an open, engaged position with a lid 104 of the container 102, according to an implementation. In some implementations, the arm body 122 can be configured to maintain a secure engagement with the lid 104 while both engaging with the lid 104 and sealing one or more openings in the lid (for example, the spout opening 130 and vent opening 132) while the arm member 118 is moved between the open and closed positions to disengage or engage the lid 104 with the container 102, respectively. In this configuration, the accessory 101 permits for the lid 104 to remain "attached", or connected, to the container 102 when the lid 104 is disengaged from the container 102, such as while refilling the container 102 with a liquid. For example, the accessory 101 can hold the lid 104 adjacent to a side or back of the container 102 when the lid 104 is removed from the upper portion of the container 102, allowing a user access to an upper opening of the container 102 without complete separation of the lid 104 from the container 102. In this way, the lid 104 is prevented from touching a potential unsanitary surface (such as a counter, table top, or other surface) or from being lost or dropped if set down while the container 102 is being refilled.

Figure 5A:
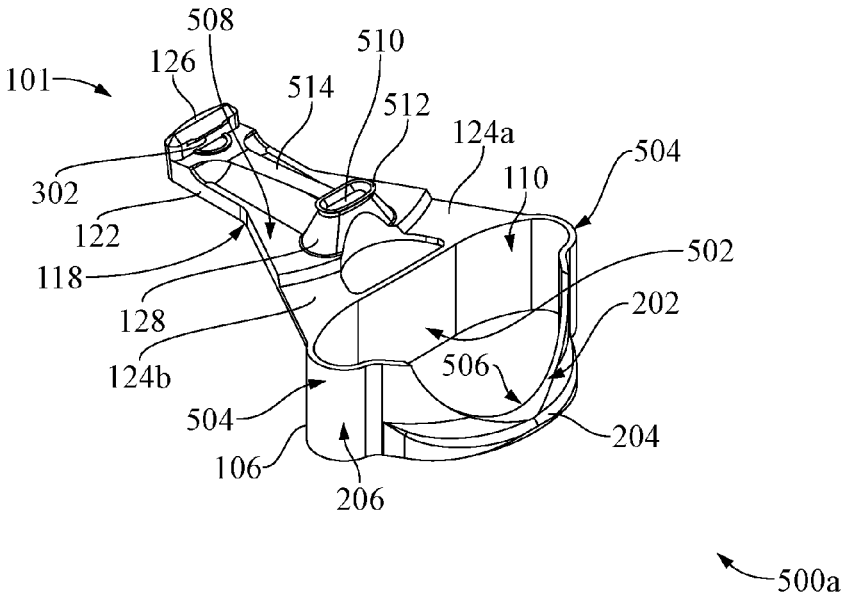
FIG. 5A is a perspective view of the accessory of FIGS. 1-4 for a container, according to an implementation.

FIG. 5A is a perspective view 500*a* of the accessory 101 of FIGS. 1-4 for the container 102, according to an implementation. As illustrated, the accessory 101 is separated from the container 102 and the lid 104 and in a relaxed, unstretched, and uninstalled (neutral) state. The container band 106 includes a substantially cylindrical shape; however, the neutral state of the container band is not exactly cylindrical. A rear section 502 of the container band 106, proximate to where the attachment band 124*a*/124*b* connects to the container band 106, has an arc-type shape with a lesser degree of curvature than adjacent side sections 504 of the container band 106. In some instances, the rear section 502 of the container band 106 can be configured to be substantially flat, with a small arc (for example, with a large radius of curvature) or no arc. The side sections 504 include a sharp curve, arc, or turn in the container band 106, for example, where the radius of curvature of the side sections 504 is substantially smaller than the rear section 502. In some implementations, the rear section 502 has a lesser degree of curvature than a corresponding container (e.g., container 102) that the accessory 101 attaches to via the container band 106. In these implementations, when the accessory 101 is installed on the container, the rear section 502 takes on a greater degree of curvature than when the rear section 502 is at rest. This increase in curvature of the rear section 502 acts to pull the attachment bands 124*a* and 124*b* as the rear section 502 takes on the greater curvature, which can contribute to biasing the arm member 118 into a closed or open position. For example, when the rear section 502 of the container band 106 pulls the attachment bands 124*a* and 124*b* as the container band 106 is installed on a container, the attachment bands 124*a* and 124*b* experience tension across the bands 124*a* and 124*b*. The tension in the attachment bands 124*a* and 124*b* biased the arm member 118 to one of the closed position or the open position because the closed position and the open position present a lesser amount of tension on the attachment bands 124*a* and 124*b* than, for example, when the arm member is at an intermediate position between the open position and the closed position. In some implementations, the described spring bias is achieved by molding the accessory 101 in the described neutral configuration. The described spring bias can also be achieved by molding the accessory 101 in a substantially open (for example, cylindrical) shape, but with changes to mold design, as will be appreciated by those of ordinary skill in the art.

A front section 506 of the container band 106 includes an arc shape with a radius of curvature greater than the radius of curvature of the rear section 502 and less than the radius of curvature of the side sections 504. For example, the rear section 502 has a first degree of curvature with a first radius of curvature, the front section 506 has a second degree of curvature greater than the first degree of the rear section and a second radius of curvature less than the first radius of curvature of the rear section 502, and the side sections 504 have a third degree of curvature greater than the second degree of curvature of the front section 506 and a radius of curvature less than the second radius of curvature of the front section 506.

These sections of the container band 106 elicit a substantially cylindrical shape such that, when installed on a container 102 with a more circular cross section than the container band 106, the arm member 118 is biased to toggle between an open position and a closed position (for example, as illustrated in FIGS. 1-4). For example, manipulating the container band 106 to form a more circular cross-section than the relaxed state of the container band 106 biases the attachment bands 124*a*/124*b* to hold the arm body 122 in one of the open or closed positions of the arm member 118.

The spout plug 126 of accessory 101 includes a protrusion extending from a bottom surface 508 of the arm body 122 configured to engage with and seal the spout opening 130, for example, by insertion of the spout plug 126 into the spout opening 130. The spout plug 126 can be sized (for example, length, width, and depth) to correspond with the size of the spout opening 130, such that insertion of the spout plug 126 into the spout opening 130 creates an air-tight and fluid-tight seal. For example, the spout plug 126 can be configured to be flared, flanged, or ridged. The engagement of the spout plug 126 and the spout opening 130 attaches the lid 104 and the arm member 118 together.

In the illustrated implementation, the spout plug 126 includes a lip flange 302 extending laterally from the spout plug 126, for example, to engage an underside surface (for example, 304 of FIG. 3) of the lid 104 adjacent to the spout opening 130. The lip flange 302 of the spout plug 126 secures the attachment of the arm member 118 and the lid 104, for example, allowing the lid 104 to remain engaged with the arm member 118 of the accessory 101 when the lid 104 is removed from (for example, not attached to) the container 102. In some implementations, the spout plug 126 can include a chamfered edge around some or all of an end periphery of the spout plug 126.

In some implementations, the vent cover 128 includes a protrusion extending from the bottom surface 508 of the arm body 122. The vent cover 128 selectively covers the vent opening 132 of the lid 104, for example, to seal the vent opening 132 from fluid communication to the outside of the container 102. The vent cover 128 can be sized (for example, in length, width, and depth) to correspond with the size or location of the vent opening 132, for example, of one or more possible vent locations on a lid 104. In some instances, the vent cover 128 includes an indentation 510 forming a lip edge 512 at a periphery of the indentation 510, where the lip edge 512 engages a top surface 116 (see FIG. 2) of the lid 104 and surrounds the vent opening 132. The lip edge 512 forms a suction-cup-type geometry, and seals the vent cover 128 over the vent opening 132.

In some implementations, the vent cover 128 can take a variety of other forms. For example, the vent cover 128 can include a flat surface covering the vent opening 132, a protrusion inserted into the vent opening 132 to plug the vent opening 132, or a flap of material configured as a thin, flexible, cantilevered plate attached to the vent cover 128 protrusion to cover the vent opening 132 using light pressure to conform and lie parallel to the lid 104. In some instances, the material or geometry of the vent cover 128 can be tuned to allow pressure within the container 102 to vent through the vent cover 128. For example, in instances where a pressure within the sealed container 102 rises above a threshold level, the vent cover 128 can be tuned to partially or completely open (for example, partially or entirely separate from the top surface 116 of the lid 104) in response to the threshold pressure level to vent the pressure in the container 102. Once the pressure in the container 102 drops below the threshold pressure level, the vent cover 128 can return to a sealing engagement with the lid 104 to cover and seal the vent opening 132 with an air-tight or liquid-tight seal.

The size, location, and attachment of the vent cover 128 and/or spout plug 126 can vary. For example, in some instances, the accessory 101 can exclude a vent cover 128. In some examples, a vent cover 128 is fixed to the container band 106, and shaped to extend from the container band 106, over an edge of the lid 104, and to a vent opening 132 to engage and seal the vent opening 132. In some instances, the spout plug 126 can be fixed to the container band 106 without a hinge-type arm member 118. For example, the spout plug 126 can be fixed to the container band 106, and shaped to extend from the container band 106, over an edge of the lid 104, and to a spout opening 130 to engage and to seal the spout opening 130. The spout plug 126 and the vent opening 132 can be separate from each other and not configured as part of the arm body 122.

In some instances, the arm member 118 includes a reinforcing rib 514 extending longitudinally along the length of the arm body 122. The reinforcing rib 514 reinforces, or rigidifies, the structure of the arm body 122. The reinforcing rib 514 is illustrated as extending along the center of the arm body 122 between the spout plug 126 and the vent cover 128. However, the reinforcing rib 514 can be configured differently. For example, the arm member 118 can include multiple reinforcing ribs of the same or varying lengths extending along various portions of the arm body 122.

Figure 5B:
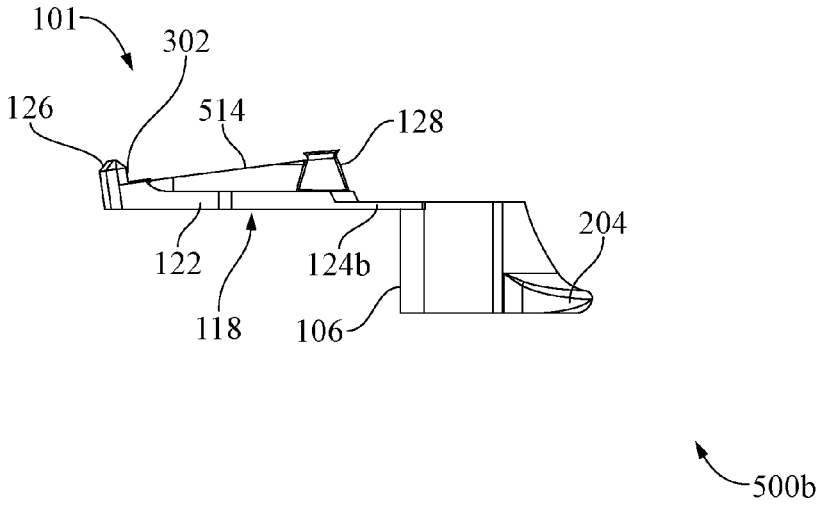
FIG. 5B is a side view of the accessory of FIGS. 1-4 for a container, according to an implementation.
Figure 5C:
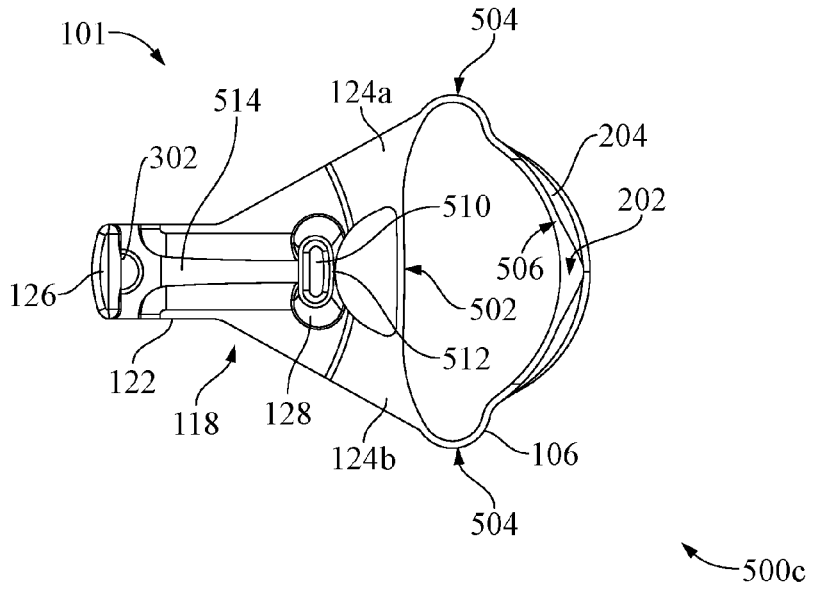
FIG. 5C is a top view of the accessory of FIGS. 1-4 for a container, according to an implementation.

FIGS. 5B and 5C are a side view 500*b* and a top view 500*c*, respectively, of the accessory 101 of FIG. 5A. As illustrated, the accessory 101 is separated from the container 102 and the lid 104 (of FIGS. 1-4), and is in a relaxed, unstretched, and uninstalled (neutral) state. FIG. 5B illustrates a side profile of the accessory 101, for example, the spout plug 126, the vent cover 128, and the reinforcing rib 514 extending from the bottom surface 508 of the arm body 122. FIG. 5B also illustrates the attachment band 124*b* as having a first thickness less than a second thickness of the arm body 122. FIG. 5C illustrates the shape of the container band 106, as previously described with respect to FIG. 5A, and as having a substantially cylindrical shape defined by the rear section 502, the side sections 504, and the front section 506. The neutral state of the container band 106 is not exactly cylindrical.

Figure 6:
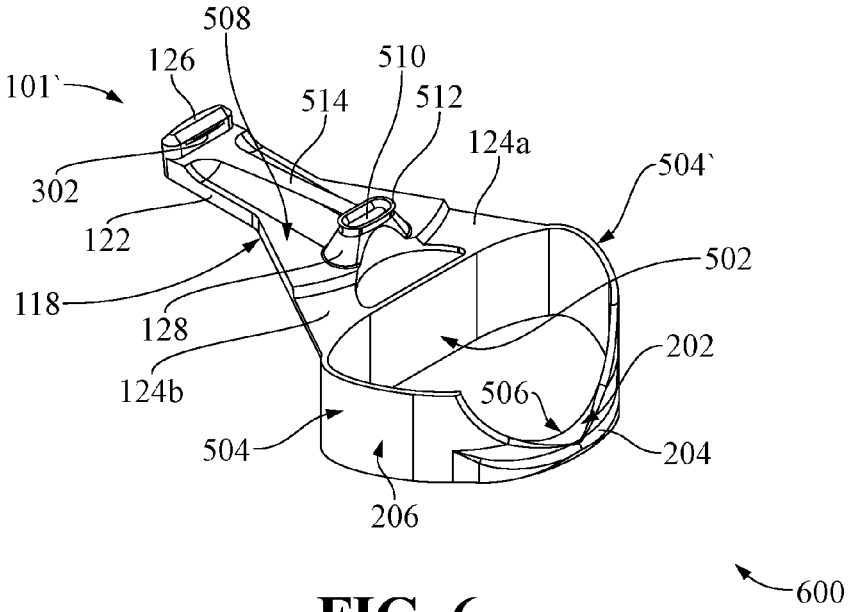
FIG. 6 is a perspective view of an alternatively-configured accessory for a container, according to an implementation.

FIG. 6 is a perspective view 600 of an alternatively-configured accessory for a container, according to an implementation. Illustrated accessory 101' is similar to accessory 101 of FIGS. 5A-5C, except the side sections 504' are configured to be of a different shape. In accessory 101', the side sections 504' include a sharper curve, or turn, in the container band 106 than the side sections 504 of FIGS. 5A-5C. The sharper curve of the side sections 504' allows a more continuous transition from the side sections 504' to the front section 506 of the container band 106.

Figure 7:
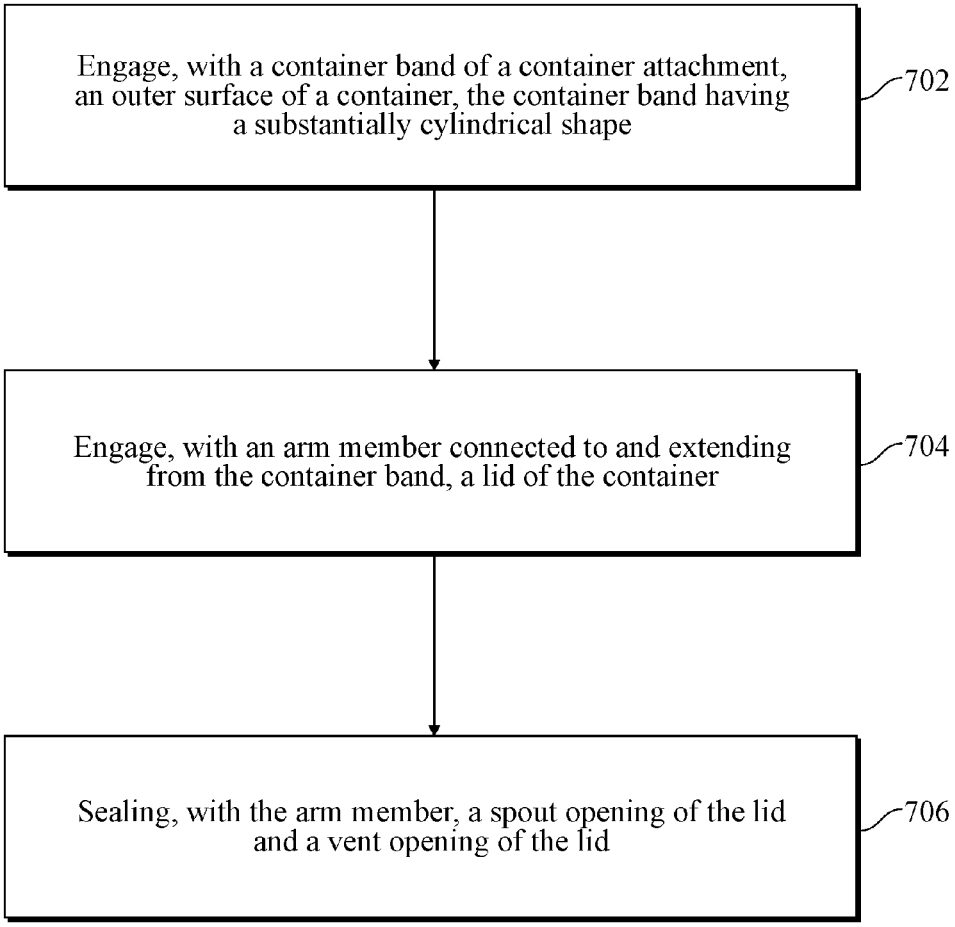
FIG. 7 is a flowchart describing an example method for use of an accessory for a container, according to an implementation.

FIG. 7 is a flowchart describing an example method 700 for use of an accessory for a container, according to an implementation. For clarity of presentation, the description that follows generally describes method 700 in the context of the other figures in this description.

At 702, a container band of an accessory engages an outer surface of a container, where the container band has a substantially cylindrical shape, for example, conforming to a shape of the container. From 702, method 700 proceeds to 704.

At 704, an arm member connected to and extending from the container band engages a lid of the container. From 704, method 700 proceeds to 706.

At 706, the arm member seals a spout opening of the lid and a vent opening of the lid. In some instances, the example method 700 further includes disengaging the arm member from the lid of the container, for example, to allow a user to drink from the spout opening of the lid. In certain instances, the method 700 includes rotating the arm member with respect to the container band, with or without the lid engaged with the arm member. In some implementations, sealing the spout opening and the vent opening includes selectively sealing the spout opening with a spout plug of the arm member and selectively sealing the vent opening with a vent cover of the arm member. After 706, method 700 stops.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed. Some operations may be considered optional in order to achieve desirable results.

Accordingly, the previously described example implementations do not define or constrain this disclosure. Other changes, substitutions, and alterations are also possible without departing from the spirit and scope of this disclosure.

What is claimed is:

1. An accessory, comprising:

a container band comprising an inner surface configured to conform to and engage an outer surface of a container; and an arm member connected to and extending from the container band, the arm member configured to selectively engage a lid of the container, the arm member comprising:

an arm body;

a flexible attachment band coupled to the container band, the attachment band connecting the arm body to the container band and configured to permit movement of the arm member between a closed first position and an open second position, wherein the attachment band includes two diverging attachment band parts that diverge from the arm body and connect to the container band at two separate respective locations, and wherein the attachment band is tensioned and the divergence of the attachment band biases the arm member toward at least one of the closed first position or the open second position;

a spout plug extending from the arm body, the spout plug configured to selectively seal a spout opening in the lid of the container; and a vent cover extending from the arm body, the vent cover configured to selectively seal a vent opening of the lid of the container.

2. The accessory of claim 1, wherein the attachment band is integrally attached to the container band.

3. The accessory of claim 1, wherein the arm body connects to the attachment band at a first end of the arm body, and the spout plug is disposed at a second end of the arm body opposite the first end.

4. The accessory of claim 1, wherein the spout plug comprises a protrusion extending from a bottom surface of the arm body, the spout plug configured to engage and selectively attach to the spout opening of the lid of the container.

5. The accessory of claim 4, wherein the protrusion comprises a lip flange extending laterally from the protrusion, the lip flange configured to engage an underside surface of the lid adjacent the spout opening.

6. The accessory of claim 1, wherein the vent cover comprises a protrusion extending from a bottom surface of the arm body, the vent cover configured to cover the vent opening of the lid of the container.

7. The accessory of claim 6, wherein the protrusion of the vent cover comprises an indentation forming a lip edge at a periphery of the indentation, the lip edge configured to engage a top surface of the lid and surround the vent opening.

8. The accessory of claim 1, wherein the arm member comprises a reinforcing rib extending along a longitudinal length of the arm body.

9. The accessory of claim 1, wherein the container band comprises a concavity configured to be positioned adjacent the spout opening of the lid of the container.

10. The accessory of claim 9, wherein the container band comprises a protrusion extending from an outer surface of the container band adjacent the concavity.

11. The accessory of claim 1, wherein the container band and the arm member are formed from a single type of flexible polymer material.

12. The accessory of claim 1, wherein the container band and the arm member are molded from a flexible polymer material.

13. A method for sealing a container lid, the method comprising:

engaging, with a container band of an accessory, an outer surface of a container;

engaging, with an arm member connected to and extending from the container band, a lid of the container;

sealing, with the arm member, a spout opening of the lid and a vent opening of the lid, and rotating the arm member with respect to the container band, wherein rotating the arm member comprises biasing, with a flexible attachment band of the arm member coupled to the container band, the arm member toward at least one of a closed first position or an open second position of the arm member, the attachment band comprising two diverging attachment band parts that diverge toward the container band and connect to the container band at two separate respective locations, wherein the attachment band is tensioned and the divergence of the attachment band biases the arm member toward at least one of the closed first position or the open second position.

14. The method of claim 13, further comprising disengaging the arm member from the lid of the container.

15. The method of claim 13, wherein sealing, with the arm member, a spout opening of the lid and a vent opening of the lid comprises:

sealing the spout opening with a spout plug of the arm member, the spout plug configured to selectively seal the spout opening; and sealing the vent opening with a vent cover of the arm member, the vent cover configured to selectively seal the vent opening.

* * * * *